US005460155A

United States Patent [19]

Hobbs, II

[11] Patent Number: 5,460,155

[45] Date of Patent: Oct. 24, 1995

[54] BEHAVIOR DETERRENCE AND CROWD MANAGEMENT

[76] Inventor: James C. Hobbs, II, 4384 Ingraham Hwy., Miami, Fla. 33133

[21] Appl. No.: 134,060

[22] Filed: Dec. 7, 1993

[51] Int. Cl.[6] ..... F41B 11/00

[52] U.S. Cl. ..... 124/56; 124/60; 124/1; 89/1.34

[58] Field of Search ..... 124/56, 59, 60, 124/1, 2; 89/1.34; 102/504, 501, 505; 43/4, 6

[56] References Cited

U.S. PATENT DOCUMENTS

| | | | |
|---|---|---|---|
| 2,111,374 | 3/1938 | Sedgley | 89/1.34 X |
| 2,469,533 | 5/1949 | Wellcome | 89/1.34 |
| 3,505,926 | 4/1970 | Johnson . | |
| 3,780,662 | 12/1973 | Sorenson . | |
| 4,505,179 | 3/1985 | Nelson et al. | 102/504 X |
| 4,559,737 | 12/1985 | Washington | 124/1 X |
| 4,741,243 | 5/1988 | Snider | 89/1.34 |
| 4,799,906 | 1/1989 | Perkins, Jr. . | |
| 5,099,747 | 3/1992 | Smith . | |
| 5,326,101 | 7/1994 | Fay | 124/1 X |

FOREIGN PATENT DOCUMENTS

| | | | |
|---|---|---|---|
| 2166225 | 4/1986 | United Kingdom | 89/1.34 |

OTHER PUBLICATIONS

R. C. Steele Summer 1992 product catalog, p. 54 disclosing Retriev–R–Trainer and Pac Dummy Launcher.

*Primary Examiner*—Randolph A. Reese

*Assistant Examiner*—Harry C. Kim

*Attorney, Agent, or Firm*—Watts Hoffmann Fisher & Heinke

[57] ABSTRACT

An apparatus for deterring an undesired behavior of at least one person. The apparatus comprises a projectile having an exterior that will not cause serious injury to a person. An actuatable launcher supports the projectile and propels the projectile in response to being actuated. A spool is mounted on the projectile or launcher. Line is wound on the spool. The line has an end portion operably connected with the launcher and another end portion operably connected with the projectile. The spool is positioned so the line is pulled from the spool after the projectile is propelled.

A method of crowd management comprises the steps of providing a plurality of projectiles. Each of the projectiles has an exterior that will not cause serious injury to a member of the crowd. A plurality of actuatable launchers is provided. Each of the launchers is capable of supporting at least one projectile and upon actuation propels the projectile along a desired path. A spool is attached with each of the projectiles or a launcher. Line is wound on each spool. The line has an end portion operably connected with the launcher and another end portion operably connected with the projectile. The plurality of projectiles are propelled away from the launchers at substantially the same time from different directions over a crowd so the lines are pulled from the spools and contact members of the crowd.

11 Claims, 4 Drawing Sheets

BEHAVIOR DETERRENCE AND CROWD MANAGEMENT

BACKGROUND OF THE INVENTION

1. Technical Field

The present invention relates generally to deterring an undesired behavior of an individual or of a group. In particular, the present invention relates to apparatus for controlling behavior, especially of an unruly crowd, through the use of fine filaments positioned over, into contact, or close to an individual and especially several individuals in a crowd.

2. Description of the Prior Art

It is well known that people or animals sometimes undertake an undesired behavior or participate in an undesired activity either alone or in a group. For example, the undesired behavior or activity of a group of people could include a riot in an urban setting, unruliness at a sporting event, disruption of a political event or cause other types of generally unacceptable misbehavior. It is often desired that civil authorities quell such undesired behavior or activity. This quelling is often accomplished by attempting to disburse the crowd into manageable smaller groups or individuals. Such attempts at disbursing a crowd are typically done by using a water canon, tear gas, rubber bullets, metal bullets or a combination of clubs and shields.

There are well-recognized disadvantages associated with each of these disbursing options. Water cannons are inconvenient to deploy and use, tear gas canisters can be picked up and thrown aside, and bullets and clubs can produce serious injuries. Clubs and shields often require the civil authorities be in relatively close proximity to the participant or crowd. Because of the required close proximity, the civil authorities, such as police, are often put at risk of injury themselves.

Thus, a need exists for an effective, remote, portable and easy to use apparatus and method to deter undesired behavior and provide crowd management. A remotely usable apparatus and method is desired to safely locate civil authorities away from the crowd or individual. Portability is desired so that the apparatus and method is readily available to civil authorities when needed. Ease of use is desired for minimal training and quick deployment when needed. While hand-held launchers are known for various projectiles and purposes, such as animal training or rescue work, they have not been modified or used with suitable projectiles or in a manner suitable for the present purposes.

SUMMARY OF THE INVENTION

The present invention is directed to a method and apparatus for deterring or preventing undesired behavior of an individual or of a crowd. The present invention fills the need for an effective, remotely locatable, portable and relatively easy to use method and apparatus for deterring undesired behavior or activity of an individual or crowd. The present invention provides an advantage by providing a way to identify participants in the undesired behavior or activity. The present invention has the further advantage of making use in a new way, and with suitable modifications, of inexpensive apparatus in large part already available.

The apparatus of the present invention is particularly suitable for deterring an undesired behavior of one individual or of a crowd. The apparatus comprises a projectile having an exterior that will not cause serious injury to an individual in the event the projectile contacts the individual. An actuatable launcher supports the projectile and includes a stored energy capacity. In response to actuation, the launcher propels the projectile away from the launcher. A spool is mounted on one of the projectile and the launcher. Line is wound on the spool. The line has one end portion operably connected with the launcher and another end portion operably connected with the projectile. The spool is positioned on the projectile or the launcher so that the line is pulled from the spool as the projectile is propelled away from the launcher. In some uses, all of the line may be pulled from the spool.

The projectile is aimed to carry the line over, near or into contact with the crowd, where the line is effective to disturb a tactile sense of individuals contacted by the line. When contacted, the tactile sense of the individual is disturbed to an extent sufficient that the individual primarily desires removal from contact with line to the exclusion of other activity. Thus, the individual ceases, at least temporarily, the undesired behavior or activity. For best effectiveness, several or many projectiles are propelled along different paths and from different locations and directions to provide such contact over a wide area of the crowd. It is also possible to impede individual movements by covering or surrounding adjacent unoccupied areas with convoluted lines.

The line is preferably several strands of nylon monofilament line wound on the spool under different tension to cause entanglement and coiling when released. The apparatus may also include a marking dye carried on the line. The dye marks an individual contacted by the line for later identification. The projectile may also include means for inducing a spiral path of the projectile and of the line as the projectile is propelled away from the launcher to increase the effective area of the line.

In one embodiment, the spool is mounted on the projectile. The projectile is formed as an elongated member with a longitudinal central axis. The spool is substantially cylindrical and mounted coaxial on the projectile. In another embodiment the apparatus includes a second projectile. A second spool is mounted on the second projectile with a second line wound on the second spool. The second line has one end connected to the launcher and another end connected with the second projectile. The second line is pulled from the second spool after the second projectile is propelled from the launcher. Preferably, the projectiles are propelled from the launcher concurrently. In another embodiment a launcher for a projectile has two or more spools with a line from each spool connected to a single projectile for pulling all of the lines from their spools when the projectile is propelled.

The present invention also provides a method of deterring undesired behavior of an individual or of a group. The method includes the steps of projecting a plurality of projectiles from different locations and in different directions to travel along paths over, near or into a crowd, carrying a line with each projectile while retaining an end of the line at one of said locations during at least part of the travel of the projectile, and contacting or surrounding the crowd with the line.

BRIEF DESCRIPTION OF THE DRAWINGS

Further features of the present invention will become apparent to those skilled in the art to which the present invention relates from reading the following specification with reference to the accompanying drawings, in which.

DETAILED DESCRIPTION OF PREFERRED EMBODIMENTS

Figure 2:
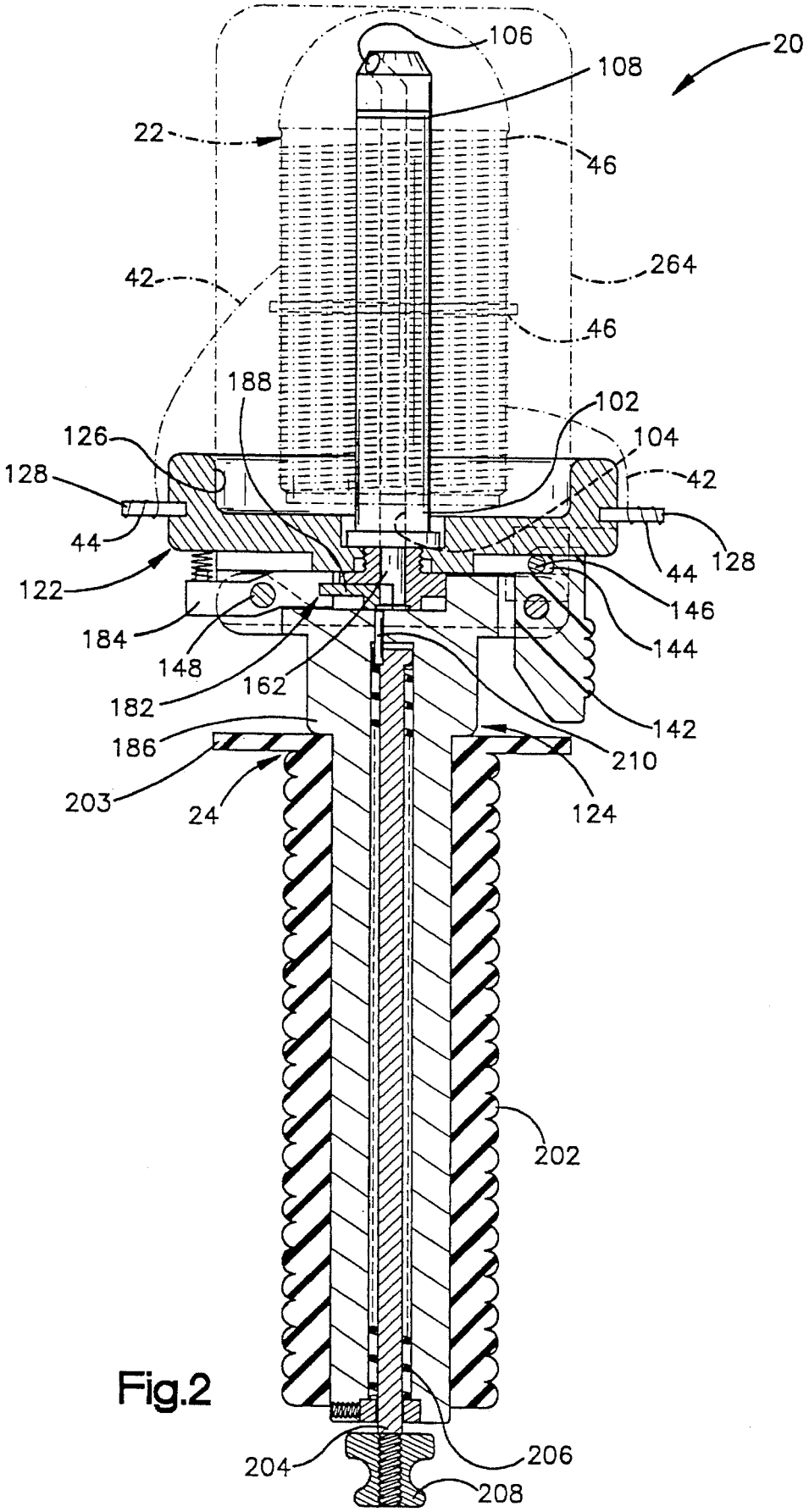
FIG. 2 is a longitudinal cross-sectional view of an apparatus embodying the present invention.

A deterrence device 20, embodying one apparatus of the present invention, is illustrated in FIG. 2. The deterrence device 20 is for deterring an undesired behavior or activity of an individual or of a crowd of individuals. The deterrence device 20 includes a projectile 22, a launcher 24 and a line 42. The line 42 has one end portion 44 operably connected with the launcher 24. The line 42 has another end portion 46 operably connected with the projectile 22.

The launcher 24 initially supports the projectile 22. The launcher 24 is actuatable to propel the projectile 22 away from the launcher. Upon actuation of the launcher 24, the projectile 22 is propelled away from the launcher along a desired path and for a predetermined distance. As the projectile 22 is propelled away from the launcher 24, the line 42 is pulled from the projectile and contacts or is positioned close to an individual to deter the undesired behavior.

The projectile 22 is preferably made with an exterior surface which is relatively soft. Such an exterior surface is preferably formed from a soft and molded elastomeric material, such as plastic or rubber. The projectile 22, thus, does not cause serious injury to a person if the projectile contacts the person. It is also desirable to keep the mass of the projectile 22 relatively low.

Figures 3, 4:
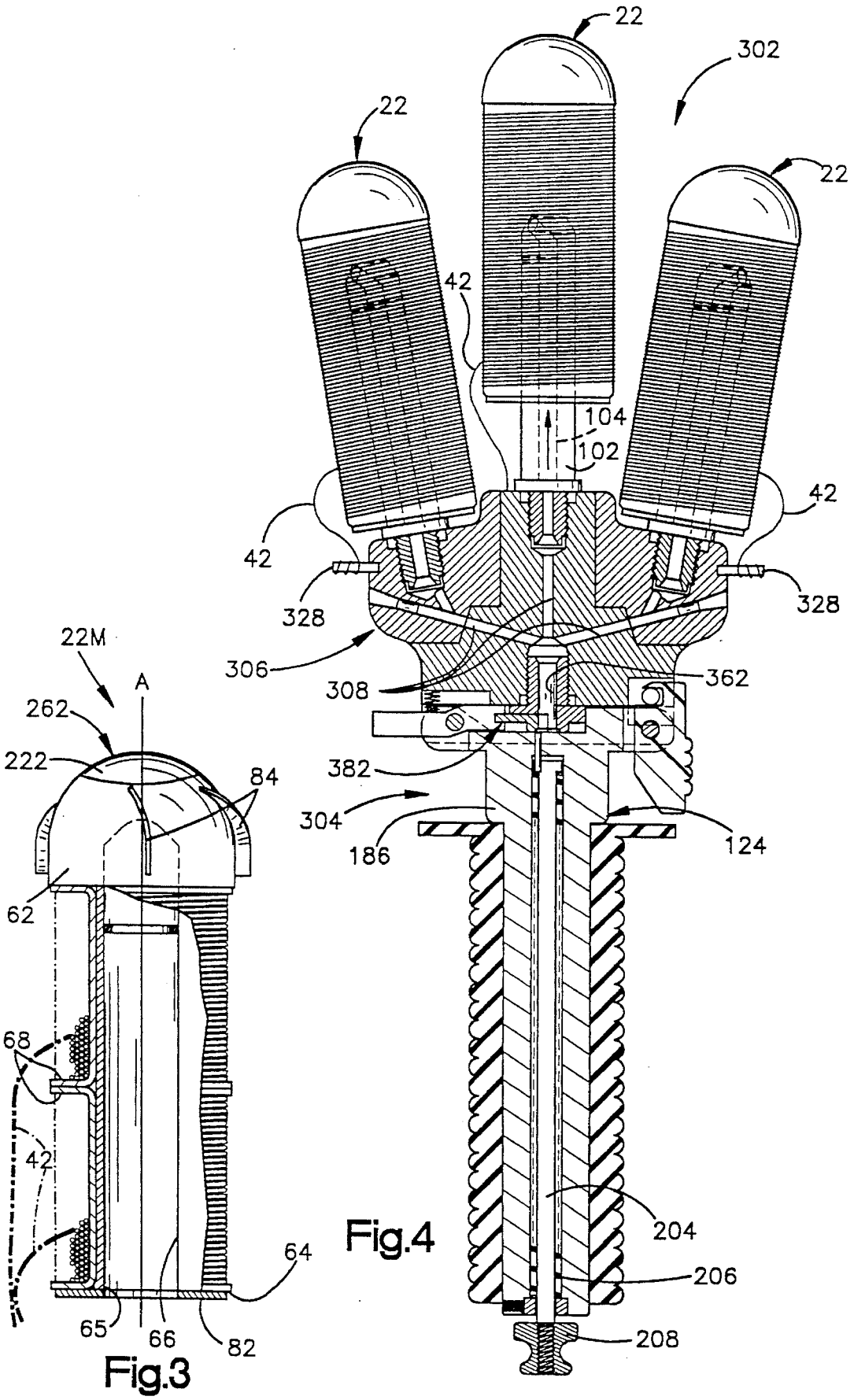
FIG. 3 is a longitudinal cross-sectional view of a modified projectile of the present invention.
FIG. 4 is a longitudinal cross-sectional view of another embodiment of an apparatus of the present invention.

The projectile 22, according to one embodiment of the present invention, has a generally elongated cylindrical shape. A modified version of the projectile 22 is illustrated in FIG. 3 as projectile 22M. The projectile 22M has a closed and rounded tip portion 62 which is the leading end as the projectile is propelled. The projectile 22M also includes a trailing end portion axially opposite the tip portion 62 and a substantially planar surface 64 with a central opening 65. The projectile 22M includes a chamber 66 extending axially from the opening 65 for the majority of the length of the projectile. The end of the chamber 66 opposite the opening 65 is closed.

The projectile 22 may have the line 42 wound directly on a outer surface portion of the projectile, as illustrated in FIG. 2. The projectile 22M may be formed to accept a spool 68, or several spools, with the line 42 already wound on the spool, as illustrated in FIG. 3. A retainer 82 is connected to the projectile 22M to prevent the spools 68 from sliding axially off of the projectile. The retainer 82 is secured to the end surface 64 of the projectile 22M in a suitable manner, such as by adhesive bonding or with a suitable fastener.

The projectile 22M may also include a plurality of helically arranged fins 84 located on the tip portion 62. The fins 84 cause the projectile 22M to rotate about its longitudinal central axis A during travel after being propelled from the launcher 24. Such rotation of the projectile 22M about the axis A causes the line 42 to partly unwind from the spool 68 during travel of the projectile. The spiral unwinding of the line 42 provides a relatively large volume of line over a given distance of travel of the projectile 22. The greater the volume of the line 42 pulled from the spool over a given distance increases the likelihood that the line deter undesired behavior. It is apparent that the projectile 22 is similar to the modified projectile 22M. The projectiles 22, 22M are intended to be interchangeable, and reference to one of the projectiles is to encompass either projectile or both and a feature of one could be included on the other.

The launcher 24 (FIG. 2) is preferably a commercially available item as is used for propelling dummies, such as ducks or birds, to train dogs in the retrieval of game. The launcher 24 initially supports the projectile 22 on a shaft 102 extending from the upper end of a mounting portion 122 of the launcher 24, as viewed in FIG. 2, prior to actuation. The shaft 102 also directs the projectile 22 along a desired path when the launcher 24 is actuated.

Prior to actuation, the projectile 22 may be positioned anywhere along the shaft 102. The shaft 102 is made from a metal material and includes an internal passage 104 extending for the majority of the length of the shaft. The passage 104 extends to an opening 106 located in a frusto-conical end portion of the shaft 102. The opening 106 is formed on the frusto-conical end portion of the shaft 102 to permit gas pressure flow into the chamber 66 (FIG. 3) of the projectile 22.

The outside diameter of the shaft 102 is formed to be slightly less than the inside diameter of the chamber 66 in the projectile 22. This provides a relatively tight radial fit between the shaft 102 and the projectile 22. Near the upper end of the shaft 102, a groove is formed and an O-ring 108 is located in the groove. The O-ring 108 provides a seal between the shaft 102 and the surface defining the chamber 66 in the projectile 22. Thus, when the passage 104 is subjected to gas pressure the O-ring 108 blocks gas leakage between the shaft 102 and projectile 22.

The shaft 102 is secured to the mounting bracket 122. The lower end portion of the shaft 102, as viewed in FIG. 2, has external threads engaged in threads formed in an opening in the mounting bracket 122. The mounting bracket 122 is pivotable relative to a handle portion 124 of the launcher 24. The mounting bracket 122 has a shallow recess 126 in which the projectile 22 is positioned. The recess 126 of the mounting bracket 122 partially encircles the lower end portion of the projectile 22, as viewed in FIG. 2, and inhibits an operator of the launcher 24 from mistakenly contacting the projectile near the lower end.

A pair of posts 128 are fixed at circumferentially spaced apart locations to the mounting bracket 122. The posts 128 serve to attach the ends 44 of the respective lines 42 to the launcher 24. The lines 42 may be attached to the post 128 by merely wrapping the ends 44 of the line around the respective post or by some other suitable means. It will be apparent that a single post 128 may attach the ends 44 of several lines 42.

The mounting bracket 122 is releasably connectable at one side with the handle portion 124 of the launcher 24 at one side by a lever 142. The mounting bracket 122 is pivotable relative to the handle portion 124 about a pin 148 on a side of the mounting bracket opposite the lever 142. To release the mounting bracket 122 for pivoting relative to the handle portion 124, the lower portion of the lever 142, as viewed in FIG. 2, is depressed radially inward relative to the handle portion 124. A latch 144 then pivots radially outward and releases a catch pin 146 of the mounting bracket 122. The mounting bracket 122 is then free to pivot about the pin 148, connecting the handle portion 124 and the mounting bracket, counterclockwise as viewed in FIG. 2, relative to the handle portion.

The pivoting action of the mounting bracket 122 relative to the handle portion 124 is desirable in order to gain access to a chamber 162 in the mounting bracket. The chamber 162 is for receiving a device (not shown) having a stored energy capacity. The stored energy device is preferably a firearm cartridge blank, such as a .22 caliber blank cartridge for a starter's pistol. When the stored energy device is ignited upon actuation, gas pressure fills the passage 104 and is communicated to the opening 106. The stored energy device is ignited in response to actuation of the launcher 24. Gas pressure fills a portion of the chamber 66 in the projectile 22 which is located above the O-ring 108 on the shaft 102. The gas pressure within the portion of the chamber 66 is effective to force the projectile 22 to be propelled off of the shaft 102. The gas pressure acting upon the increasing volume of the chamber 66 in the projectile 22 located above the O-ring 108 to move the projectile upwardly off of the shaft 102, as viewed in FIG. 2.

The .22 caliber blank cartridge provides sufficient force to propel the projectile 22 a distance of approximately 180 to 280 feet from the launcher 24. This distance depends on the strength of the charge, the angle at which the shaft 102 is disposed at the moment of ignition of the cartridge and the initial position of the projectile 22 along the shaft 102 at the moment of ignition. For a first example, if the angle of the shaft 102 relative to level ground is 45°, the projectile 22 is positioned as far axially downward as possible on the shaft and the strength of the charge is as great as possible, the projectile 22 is propelled the maximum distance of 280 feet. For a second example, if the angle of the shaft 102 changes from the 45° orientation, the strength of the charge is decreased and/or the projectile 22 is initially located upwardly along the shaft 102 away from the mounting bracket 122, the projectile will be propelled less than the maximum distance of 280 feet. However, if all the conditions are the same as in the first example but the angle of the shaft 102 is 68°, the projectile will be propelled less than 280 feet away from the operator, but travels upwardly a relatively greater distance so a relatively larger volume of line 42 is dispersed over the relatively shorter distance.

The projectile 22 initially may be located anywhere along the length of the shaft 102 below the O-ring 108, before actuation of the stored energy device. The shaft 102 may include graduated markings indicative of an approximate distance that the projectile 22 will be propelled when the shaft 102 is oriented at a 45° angle relative to level ground with a selected charge. This gives the operator some guidance as to distance of travel. The further the projectile 22 is initially positioned down the shaft 102, generally the further the projectile will travel, because the pressure above the O-ring 108 acts on projectile for more of the length of the chamber 66.

The mounting bracket 122 of the launcher 24 includes an ejector mechanism 182. The ejector mechanism 182 partially ejects a spent cartridge casing from within the chamber 162 upon the mounting bracket 122 pivoting about 120° relative to the handle portion 124. Upon reaching 120° of relative pivotal movement, an ejector lever 184 engages an outer surface of a tubular housing 186 of the handle portion 124. The ejector lever 184 forces an ejector 188 to move in a direction axially in a direction away from the shaft 102 and any cartridge in the chamber 162 is moved partially away from the chamber. The cartridge may now be removed manually from the chamber 162.

The handle portion 124 of the launcher 24 includes a rubberized hand grip 202 extending axially for the majority of the length of the tubular portion 186. The hand grip 202 is open on both ends to form a tube to receive the tubular housing 186 therein. The hand grip 202 includes a flange portion 203 which serves to prevent an operator from getting parts of a body, such as a hand, from getting caught in the release lever 142 or ejector mechanism 182. A firing mechanism 204 extends coaxially inside the tubular housing 186. A spring 206 biases the firing mechanism 204 to the position illustrated in FIG. 2. To initiate actuation of the launcher 24, an operator pulls a handle 208 connected to the lower end, as illustrated in FIG. 2, of the firing mechanism 204. The firing mechanism 204 moves at least partially axially outward of the tubular housing 186. Upon release of the firing mechanism 204 by the operator, the spring 206 forces the firing mechanism 204 upwardly within the tubular housing 186. A firing pin 210 attached to the upper end of the firing mechanism 204 engages the cartridge located in the chamber 162 to complete actuation and ignite the stored energy capacity within the cartridge.

Figure 6:
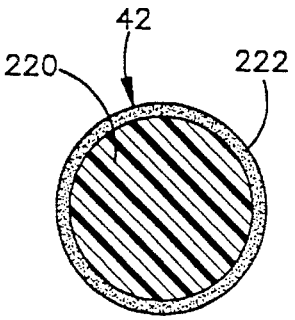
FIG. 6 is an enlarged cross-sectional view of an embodiment of a line of the present-invention.

As illustrated in FIG. 6, the line 42 is in the form of a monofilament line 220, such as nylon. The monofilament line 220 is preferably a fishing line of about a five-pound test strength. It is not intended that the monofilament line 222 has much strength, such as the strength to retrieve a person or carry a rescue line as in known rescue devices. The monofilament line 220 would have sufficient strength to retrieve the projectile 22, as long as the projectile is not caught on something. Preferably the monofilament line 220 has little strength in order to minimize mass of the line 42 but enough surface area and weight to disturb a person's tactile sense upon contact.

Figure 7:
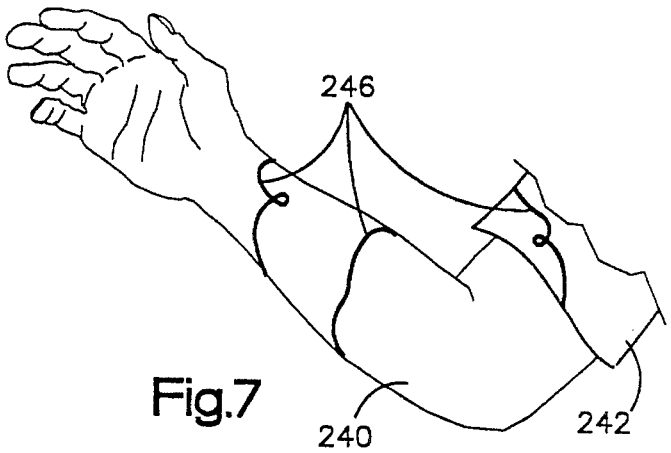
FIG. 7 is a perspective view of a human arm and a portion of clothing, both of which have markings from contact with the line illustrated in FIG. 6.

The monofilament line 220 has a diameter of about 0.010 to 0.015 inch and is preferably coated with a dye or ink coating 222. The coating 222 is preferably of such a nature that it is not easily removed from clothing or skin of a person contacted by the line. Such coating 222 can be placed on the monofilament line 220 in the form of a liquid, paint or powder. Such coating 222 may also be visible only when exposed to certain spectrums of light, such as a ultraviolet light. Thus, a person that comes in contact with the line 42 is marked for later identification, as illustrated in FIG. 7. A person's arm 240 or clothing 242 is illustrated as having marks 246 thereon resulting from contact with the coating 222 on the monofilament line 220. The line 42 may be more than one strand of monofilament line wound on the spool 68 with equal or different tension.

The projectile 22, the tip 262 (FIG. 3) of the projectile 22 may optionally be coated with the same coating 222 that encapsulates the nylon monofilament line 220. Thus, the projectile 22 can also be used as an identifying device by propelling it directly at a target person and contacting the person with the tip 262 of the projectile. The coating 222 on the tip 262 then remains on person's clothing or skin. A protective cover 264 (FIG. 2) may be provided that tightly fits into the recess 126 in order to prevent any of the coating 222 that is on the line 42 or on the tip 262 of the projectile 22 from rubbing off before use. It is intended that the cover 264 be removed from the launcher 24 prior to actuation of the launcher. However, in an emergency situation, the launcher 24 can be actuated while the cover 264 is still located within the recess 126. In such an emergency situation, the cover 264 will be propelled away from the launcher 24 with the projectile 22.

To prepare the deterrence device 20 for operation, the launcher 24 is opened by pivoting the mounting bracket 122 relative to the handle portion 124. A cartridge is placed in the chamber 162. The mounting bracket 122 is then pivoted to the closed position relative to the handle portion 124, as illustrated in FIG. 2, so that the latch 144 of the handle portion receives the catch pin 146.

Figure 1:
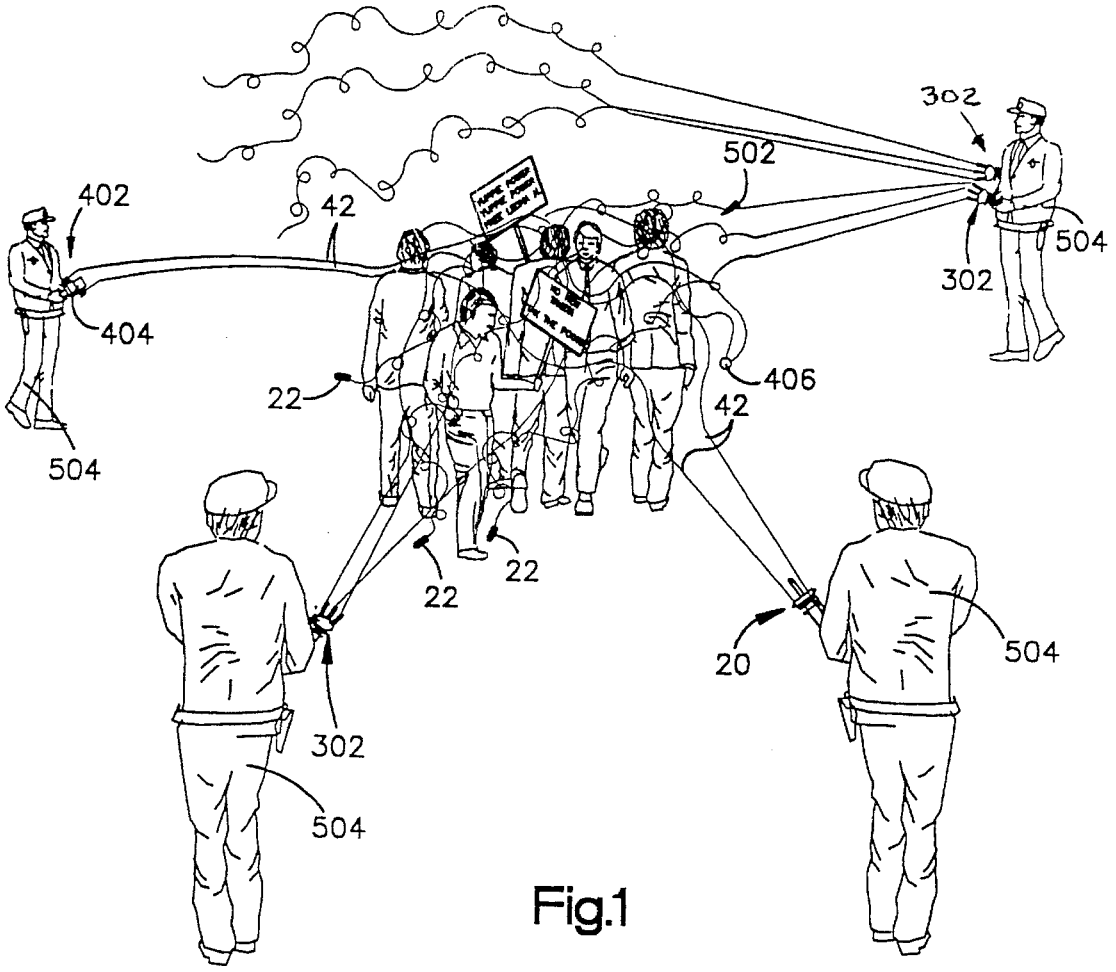
FIG. 1 is a perspective view of a method of crowd management embodying the present invention using an apparatus of the present invention.

When the deterrence device 20 is used, the deterrence device is positioned in a use position. For example, as illustrated in FIG. 1, a police officer 504 would hold the launcher 24 in one hand. The police officer 504 would then aim the launcher 24 in a desired direction at an appropriate path of travel above or near a person. The handle 208 of the firing mechanism 204 is pulled axially outwardly from the tubular housing 186. Upon releasing the handle 208 of the firing mechanism 204, the firing pin 210 contacts the cartridge in chamber 162 to pressurize the passage 104 of the shaft 102 and chamber 66 of the projectile 22 with expanding gas. The projectile 22 is then forced off of the shaft 102 along the desired path of travel.

The projectile 22 is propelled over and above or near a person who is participating in an undesired behavior or an undesired activity. As the projectile 22 travels along the desired path, the line 42 is pulled from the projectile. When the line 42 contacts the person, the line 42 disturbs a tactile sense of the person. The tactile sense is disturbed by the relatively light touch of the line 42 against exposed skin or hair. Sometimes the touch is accompanied by an inability to clearly see the line 42. The light touch of the line 42 is sufficient enough that the person desires nothing but to remove the line. This desire to avoid contact with the line 42 is generally at the exclusion of the undesired behavior or activity. This permits the police officer to either subdue the person or cause the person to flee away. In any event, the person ceases to perform the undesired behavior or activity. The marking 246 of the person by the coating 222 later serves to aid in the identification of the person if the person fled away from the location of the undesired behavior. The projectile 22 may also be propelled into an area to surround and impede movement of the crowd or individual.

An alternative embodiment of the deterrence device 302 of the present invention is illustrated in FIG. 4. The deterrence device 302 is similar in structure and operation to the deterrence device 20 illustrated in FIG. 2 and described above. The deterrence device 302 includes a launcher 304 which has a handle portion 124 identical to the handle portion of the launcher 24 of the deterrence device 20. However, the launcher 304 includes a modified mounting bracket 306 for supporting more than one projectile 22. Each of the projectiles 22 has a respective line 42 wound thereon.

The deterrence device 302 preferably includes three projectiles 22. Three projectiles 22 are illustrated in FIG. 4 by way of example only and as a number which is suitably more than a single projectile. It will be apparent that any suitable number of projectiles 22 may be used as long as the cartridge has a stored energy capacity which can propel all the projectiles a sufficient distance. The projectiles 22 illustrated in FIG. 4 may be identical to the projectiles illustrated in FIGS. 2 and 3 and described above.

The mounting bracket 306 is formed to accept and support the three projectiles 22. The mounting bracket 306 utilizes a chamber 362 and an ejector mechanism 382 identical to the chamber 162 and ejector mechanism 182 of the deterrence device 20. The mounting bracket 306 is pivotable relative to the handle portion 124. The mounting bracket 306 includes three shafts 102, each with a respective passage 104. Each shaft 102 is identical to the shaft in the deterrence device 20 and has an O-ring thereon. The mounting bracket 306 also includes three posts 328 for attaching an end of a respective line 42. The mounting bracket 306 also includes a three internal passages 308 in communication between a passage 104 in a respective shaft 102 and the chamber 362.

In operation, the launcher 304 is actuated by moving the firing mechanism 204 axially outward of the tubular housing 186. When the handle 208 of the firing mechanism 204 is released, the spring 206 moves the firing mechanism towards the position illustrated in FIG. 4. A cartridge located within the chamber 362 is ignited. The ignited cartridge pressurizes the passages 308 and 104 with expanding gas in order to propel the three projectiles 22 away from the launcher 304 at substantially the same time.

Upon propelling of the projectiles 22, the line 42 wound on each projectile is pulled from the spools. The lines 42 propelled over an area provides more chances that a person in the area will be contacted, and undesired behavior deterred. It will be apparent that each of the projectiles 22 of the deterrence device 302 will travel less distance for a given stored energy charge than the single projectile of deterrence device 20 because of the increased mass to be propelled and because of the increased volume of the passages 308, 104 and chambers 66 that is exposed to the gas pressure.

Figure 5:
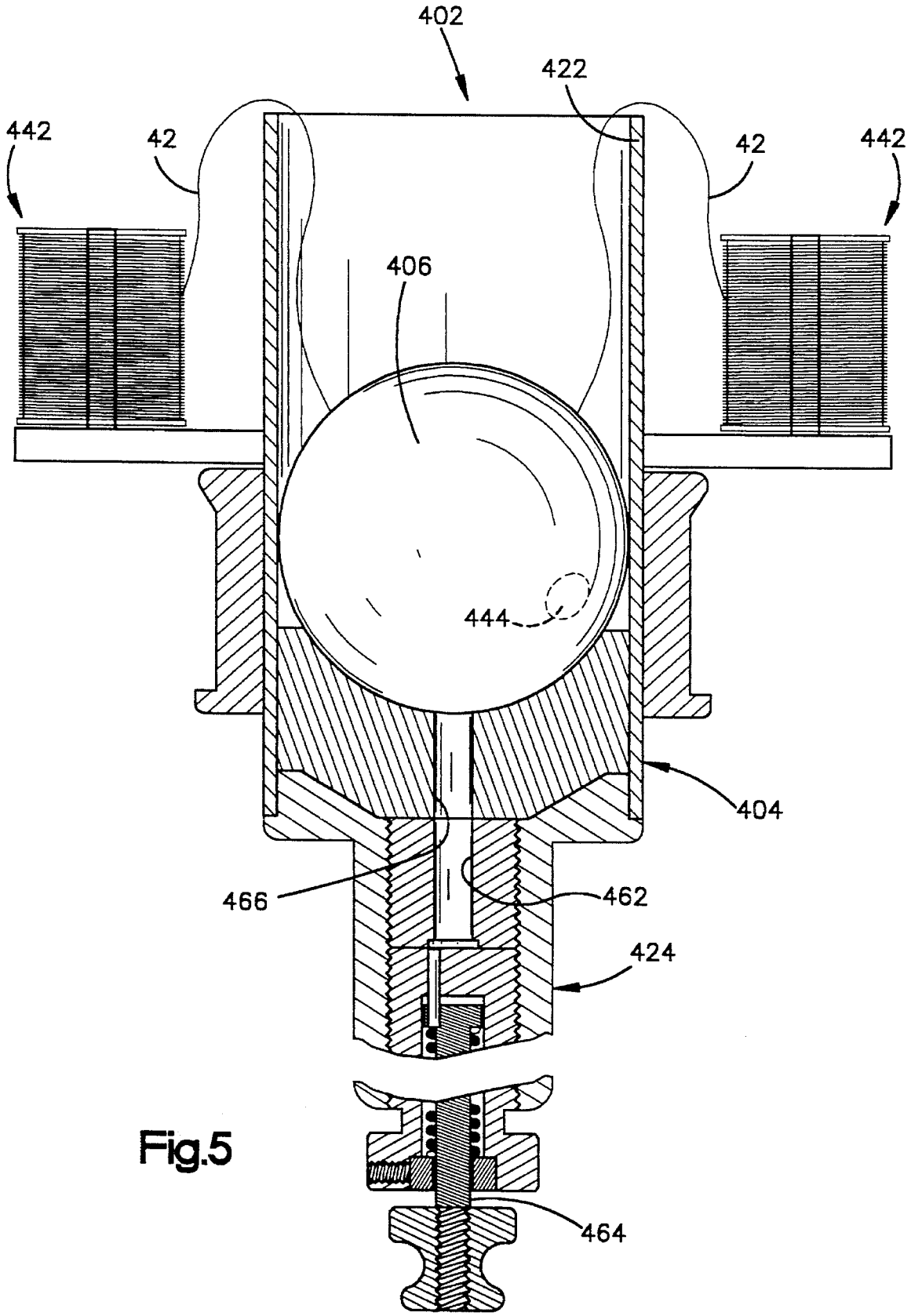
FIG. 5 is a longitudinal cross-sectional view of another embodiment of an apparatus of the present invention.

Another embodiment of a deterrence device 402 is illustrated in FIG. 5. The deterrence device 402 includes a launcher 404 for supporting and propelling a single projectile 406 away from the launcher. The launcher 404 includes a tubular support 422 attached to a handle portion 424. The projectile 406 preferably has a spherical configuration. The outside diameter of the spherical projectile 406 closely fits within the inside diameter of the tubular member 422.

At least one spool 442 is operably connected with the launcher 104 at the exterior of the tubular member 422. In this embodiment of the present invention, two spools 442 are illustrated as connected to the launcher 404. Each spool 442 has a line 42 wound thereon. An end of the line 42 is connected to the spherical projectile 406.

When the spherical projectile 406 is propelled from the launcher 404 the lines 42 leave from the spools 442 attached to the launcher 404. The projectile 406 has a relatively lower mass than the projectile 22 in the other embodiments which have the spool 68 and/or line 42 attached directly to the projectiles and propelled therewith. The spherical projectile 406 may include a weight 444 which is offset from the center of the spherical projectile. The offset weight 444 induces a tumbling effect of the projectile 406 as the projectile is propelled and that tumbling causes the line 42 to unwind with a generally spiral configuration.

The handle portion 424 of the launcher 404 includes a chamber 462 for receiving a cartridge blank. A firing mechanism 464 is actuated to engage the cartridge blank and caused the stored energy charge to ignite. A passage 466 in the launcher 404 is subjected to gas pressurization from the igniting stored energy in the cartridge. The gas pressurization within the passage 466 and inside of the tubular member 422 below the spherical projectile 406, as it moves, provides a force to propel the spherical projectile away from the launcher 404. The spherical projectiles 406 is propelled from the launcher 404 in a direction in which the tubular member 422 is aimed.

A method of using one or more of the deterrence devices 20, 302, 402 is illustrated in FIG. 1. A crowd 502 of six is illustrated as participating in an undesired activity which civil authorities want ceased. Four police officers 504 partially surround the crowd 502 from different directions and at a spaced distance, beyond the reach of any one member of the crowd. At approximately the same time each police officer 504 actuates a respective one of the deterrence devices 20, 302, 402.

Each deterrence device 20, 302, 402 propels its respective projectile or projectiles 22, 406 from the launcher 24, 304, 424 over, above, around and into the crowd 502. As the lines 42 unwind they engage and contact members of the crowd 502. Contact with the lines 42 serves to, at least temporarily, disrupt the undesirable behavior of the members of the crowd 502 to an extent that each member is distracted and disturbed, and primarily wants to remove himself or herself from the contact with the lines. This permits the police officers 504 to do a variety of things, such as merely dispersing the crowd 502 by causing the members of the crowd to flee or to subdue selected members or all of the members of the crowd.

From the above description of the preferred embodiments of the invention, those skilled in the art will perceive improvements, changes and modifications. Such improvements, changes and modifications within the skill of the art are intended to be covered by the intended claims.

Having described at least one preferred embodiment of the invention, what is claimed is:

1. An apparatus for deterring an undesired behavior of at least one individual, said apparatus comprising:

a projectile having an exterior that will not cause serious injury to an individual in the event that said projectile contacts the individual;

an actuatable launcher for supporting said projectile, said launcher having a stored energy capacity for imparting a propelling force to said projectile in response to being actuated to move said projectile away from said launcher;

a spool mounted on one of said projectile and said launcher;

line wound on said spool prior to said projectile being propelled from said launcher, said line having a first end portion operably connected with said launcher and a second opposite end portion operably connected with said projectile, said spool positioned on said one of said projectile and said launcher so said line separates from said spool after said projectile moves away from said launcher; and a marking medium carried by said line to serve to identify an individual contacted by said line.

2. An apparatus for deterring an undesired behavior of at least one individual, said apparatus comprising:

a projectile having an exterior that will not cause serious injury to an individual in the event that said projectile contacts the individual;

an actuatable launcher for supporting said projectile, said launcher having a stored energy capacity for imparting a propelling force to said projectile in response to being actuated to move said projectile away from said launcher;

a spool mounted on one of said projectile and said launcher;

line wound on said spool prior to said projectile being propelled from said launcher, said line having a first end portion operably connected with said launcher and a second opposite end portion operably connected with said projectile, said spool positioned on said one of said projectile and said launcher so said line separates from said spool after said projectile moves away from said launcher; and a second projectile, a second spool mounted on said second projectile and a second line wound on said second spool, said second line having an end portion operably connected with said launcher and another end portion operably connected with said second projectile, said second line separates from said second spool as said second projectile moves away from said launcher.

3. The apparatus set forth in claim 2 wherein said projectiles move away from said launcher at a substantially simultaneous time by said propelling force.

4. An apparatus for deterring an undesired behavior of at least one individual, said apparatus comprising:

a projectile having an exterior that will not cause serious injury to an individual in the event that said projectile contacts the individual;

an actuatable launcher for supporting said projectile, said launcher having a stored energy capacity for imparting a propelling force to said projectile in response to being actuated to move said projectile away from said launcher;

a spool mounted on one of said projectile and said launcher;

line wound on said spool prior to said projectile being propelled from said launcher, said line having a first end portion operably connected with said launcher and a second opposite end portion operably connected with said projectile, said spool positioned on said one of said projectile and said launcher so said line separates from said spool after said projectile moves away from said launcher; and a marking medium carried by said projectile at a leading end, said marking medium useful to identify an individual contacted by said leading end of said projectile.

5. An apparatus for deterring an undesired behavior of at least one individual, said apparatus comprising:

a projectile having an exterior that will not cause serious injury to an individual in the event that said projectile contacts the individual;

an actuatable launcher for supporting said projectile, said launcher having a stored energy capacity for imparting a propelling force to said projectile in response to being actuated to move said projectile away from said launcher;

a spool mounted on one of said projectile and said launcher; and line wound on said spool prior to said projectile being propelled from said launcher, said line having a first end portion operably connected with said launcher and a second opposite end portion operably connected with said projectile, said spool positioned on said one of said projectile and said launcher so said line separates from said spool after said projectile moves away from said launcher, and said line comprising multiple strands of monofilament line wound onto said spool with different tensions.

6. An apparatus for deterring an undesired behavior of at least one individual, said apparatus comprising:

a weight having an exterior that will not cause serious injury to an individual in the event that said weight contacts the individual;

an ejector for launching said weight, a spool located on said weight or at said ejector, and line wound on said spool, said line connected to said weight and releasable from said spool as the weight moves away from said ejector, said line comprising multiple strands of monofilament line wound onto said spool with different tensions.

7. Apparatus as set forth in claim 6 including a marking medium carried by said line or said weight, or both, to serve to identify an individual contacted by said medium.

8. An apparatus for deterring an undesired behavior of at least one individual, said apparatus comprising:

a weight having an exterior that will not cause serious injury to an individual in the event that said weight contacts the individual;

an ejector for launching said weight, a spool located on said weight or at said ejector, line wound on said spool, said line connected to said weight and releasable from said spool as the weight moves away from said ejector; and a marking medium carried by said line or said weight, or both, to serve to identify an individual contacted by said medium.

9. A method of deterring an undesired behavior of an individual, said method comprising the steps of:

providing a projectile with an exterior that will not cause injury to an individual in the event that the projectile contacts the individual;

providing an actuatable launcher for supporting the projectile, the launcher having a stored energy capacity which, upon actuation, propels the projectile away from the launcher;

attaching a spool to one of the projectile and the launcher;

providing line wound on the spool prior to the projectile being propelled away from the launcher, the line having one end portion operably connected with the launcher and another end portion operably connected with the projectile;

providing a marking medium carried on the line to mark an individual contacted by the line for identification purposes at a later time;

actuating the launcher to cause the stored energy to propel the projectile away from the launcher; and pulling the line from the spool.

10. A method of deterring an undesired behavior of an individual, said method comprising the steps of:

providing a projectile with an exterior that will not cause injury to an individual in the event that the projectile contacts the individual;

providing an actuatable launcher for supporting the projectile, the launcher having a stored energy capacity which, upon actuation, propels the projectile away from the launcher;

attaching a spool to one of the projectile and the launcher;

providing line wound on the spool prior to the projectile being propelled away from the launcher, the line having one end portion operably connected with the launcher and another end portion operably connected with the projectile;

providing a second projectile;

providing a second spool attached to one of the second projectile and the launcher;

providing a second line wound on the second spool prior to the second projectile being propelled from the launcher, the second line having one end portion operably connected with the launcher and other end portion operably connected with the second projectile;

mounting the second projectile on the launcher;

actuating the launcher to cause the stored energy to propel the first projectile away from the launcher;

pulling the line from the first spool; and propelling the second projectile from the launcher.

11. The method set forth in claim 10 further including the step of propelling the projectiles away from the launcher with the stored energy at a substantially simultaneous time.

* * * * *